US005092691A

United States Patent [19]

Iwata

[11] Patent Number: 5,092,691

[45] Date of Patent: * Mar. 3, 1992

[54] PRINTING MACHING HAVING A TYPE WHEEL SUPPORTING STRUCTURE

[75] Inventor: Nobuo Iwata, Sagamihara, Japan

[73] Assignee: Ricoh Company, Ltd., Tokyo, Japan

[ * ] Notice: The portion of the term of this patent subsequent to Jan. 8, 2008 has been disclaimed.

[21] Appl. No.: 605,992

[22] Filed: Oct. 30, 1990

Related U.S. Application Data

[60] Division of Ser. No. 219,837, Jul. 7, 1988, Pat. No. 4,983,055, which is a continuation of Ser. No. 857,124, Apr. 29, 1986, abandoned, which is a continuation of Ser. No. 581,276, Feb. 17, 1984, abandoned.

[30] Foreign Application Priority Data

| | | | |
|---|---|---|---|
| Feb. 23, 1983 | [JP] | Japan | 58-43514 |
| Mar. 26, 1983 | [JP] | Japan | 58-27715 |
| Mar. 26, 1983 | [JP] | Japan | 58-43515 |

[51] Int. Cl.[5] ..... B41J 1/30

[52] U.S. Cl. ..... 400/144.2; 400/175

[58] Field of Search ..... 400/144.3, 175, 356, 400/144.2; 101/93.19

[56] References Cited

U.S. PATENT DOCUMENTS

| | | | |
|---|---|---|---|
| 4,074,798 | 2/1978 | Berger | 400/144.2 |
| 4,124,312 | 11/1978 | Johnson | 400/144.2 |
| 4,161,373 | 7/1979 | Chvatlinsky | 400/175 |
| 4,245,916 | 1/1981 | Habich et al. | 400/144.2 |
| 4,389,130 | 6/1983 | Giolitti | 400/144.2 |
| 4,507,001 | 3/1985 | Babler | 400/175 |
| 4,678,352 | 7/1987 | Kittel et al. | 400/144.2 |

FOREIGN PATENT DOCUMENTS

| | | | |
|---|---|---|---|
| 38691 | 10/1981 | European Pat. Off. | 400/144.2 |
| 3043162 | 7/1982 | Fed. Rep. of Germany | 400/144.2 |
| 41205 | 3/1980 | Japan | 400/175 |
| 42658 | 4/1981 | Japan | 400/144.2 |
| 51469 | 3/1982 | Japan | 400/144.2 |
| 197168 | 12/1982 | Japan | 400/144.2 |

OTHER PUBLICATIONS

*IBM Tec Disc Bull,* "Improving Print Wheel Inertia in Impact Printer", Kane; vol. 21, No. 6, Nov. 1978, pp. 2201–2202.

*IBM Tech Disc. Bull;* "Print Wheel Misregistration Protecter"; Springer; vol. 24, No. 8, Jan. 1982, pp. 4346–4347.

*IBM Tech Disc Bull;* "Printwheel Cartridge w/Knurled Ribbon Guide Surface"; Aldrich et al.; vol. 26, No. 12, May 1984; p. 6629.

*Primary Examiner*—David A. Wiecking

*Attorney, Agent, or Firm*—Cooper & Dunham

[57] ABSTRACT

A printing machine having a structure for detachably supporting a cassette housing therein a type wheel is provided. The structure includes a cassette holder which may be pivoted between an operative position where printing may be carried out and an inoperative position where no printing is effected but the cassette may be replaced by another. The structure also includes a motor supporting member for supporting thereon a selection motor which may be engaged with or disengaged from the type wheel, wherein the motor supporting member is also pivoted to the cassette holder in a depending manner and moves between two positions in association with the pivotal movement of the cassette holder. Also provided is a guiding mechanism for guiding the movement of the motor supporting member thereby insuring that the motor is brought into engagement with the type wheel when located at the operative position and the motor is disengaged from the type wheel when located at the inoperative position. In accordance with another aspect of the present invention, there is provided a cassette for housing therein a type wheel, which is provided with ribs for guiding the advancement of an ink ribbon. In accordance with a further aspect of the present invention, there is provided a cassette for housing therein a type wheel, which is provided with a printing window which is located as shifted sideways with respect to a vertical center line passing through a rotating center of the type wheel.

32 Claims, 3 Drawing Sheets

PRINTING MACHING HAVING A TYPE WHEEL SUPPORTING STRUCTURE

This application is a division of Ser. No. 07/219,837, filed on July 7, 1988 and issued as U.S. Pat. No. 4,983,055 on Jan. 8, 1991, which is a continuation of Ser. No. 06/857,124, filed on Apr. 29, 1986, now abandoned, which is a continuation of Ser. No. 06/581,276, filed Feb. 17, 1984, now abandoned.

BACKGROUND OF THE INVENTION

1. Field of the Invention

This invention generally relates to printing machines, such as printers and typewriters, using a type wheel for printing characters which is rotatably housed in a cassette, and particularly to a structure for detachably supporting such a cassette-housed type wheel. The present invention also relates to a cassette for rotatably housing therein a type wheel, which may be detachably inserted into the type wheel supporting structure of a printing machine.

2. Description of the Prior Art

Printing machines using a type wheel for printing characters are well known in the art. In such wheel printers, several type wheels having different fonts may be selectively and detachably mounted in position for printing desired characters. A typical structure for detachably supporting such a type wheel, which is normally housed in a cassette, is disclosed, for example, in Japanese Patent Laid-open Publications Nos. 56-144968 and 56-144969. In the disclosed structure, a selection motor for driving to rotate a type wheel thereby having a selected type located at a predetermined printing position is mounted a on motor supporting frame which is provided to be located closer to or separated away from a platen roller. Also provided is a spring which is connected to urge the supporting frame in the direction directed away from the platen roller; on the other hand, also provided is an operating lever which causes, when operated manually, the supporting frame to be located closer to the platen roller against the force of the spring. A holding member is also provided for holding the supporting frame at that location closer to the platen roller.

The prior art structure for supporting a type wheel housed in a cassette as described above is extremely complicated in structure and thus difficult to assemble and expensive to manufacture. Moreover, a replacing operation of type wheels in such a prior art structure cannot be carried out smoothly and requires skills and experiences.

SUMMARY OF THE INVENTION

It is therefore a primary object of the present invention to obviate the above-described disadvantages of the prior art.

Another object of the present invention is to provide an improved printing machine using detachably mountable type wheels.

A further object of the present invention is to provide an improved structure for detachably supporting a cassette-housed type wheel in a printing machine.

A still further object of the present invention is to provide a type wheel supporting structure in a printing machine which is simple in structure and easy to manufacture.

A still further object of the present invention is to provide a type wheel supporting structure in a printing machine into which the cassette-housed type wheel may be detachably inserted easily as well as smoothly.

A still further object of the present invention is to provide a novel cassette for rotatably housing therein a type wheel having a hub, a plurality of spokes extending radially therefrom and types provided at the free ends of the spokes, which is to be detachably mounted in a printing machine.

A still further object of the present invention is to provide a print wheel cassette provided with an ink ribbon guide for guiding the movement of ink ribbon.

A still further object of the present invention is to provide a print wheel cassette provided a profiled window through which an impact hammer may extend to impact a selected type and an increased number of typed characters on a sheet of paper may be observed.

Other objects, advantages and novel features of the present invention will become apparent from the following detailed description of the invention when considered in conjunction with the accompanying drawings.

Figure 1:
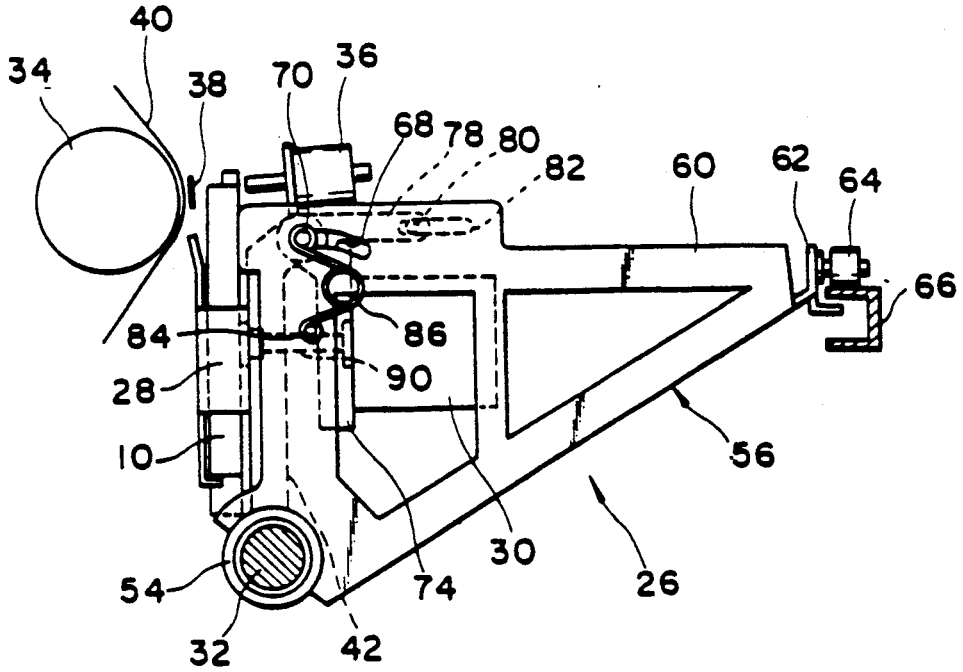
FIG. 1 is a partial, side elevational view of the printing machine using a type wheel showing the type wheel supporting structure embodied in the carriage of printing machine in accordance with the present invention.
Figure 2A:
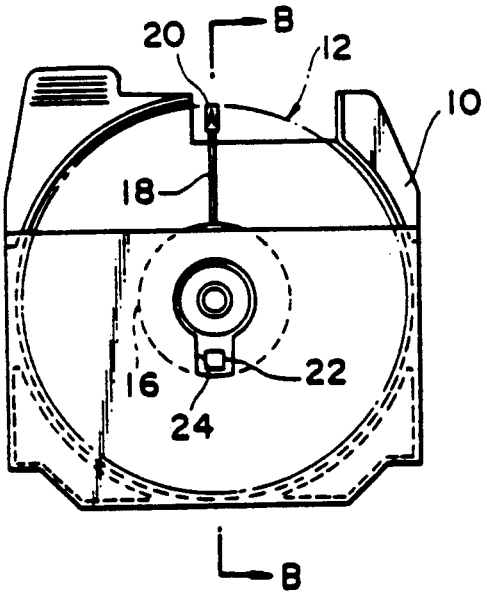
Figure 2B:
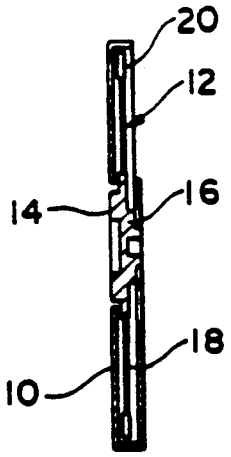

FIG. *2a* is a front view showing the overall structure of a cassette-housed type wheel embodying the present invention which may be detachably mounted in the structure shown in FIG. 1;

FIG. *2b* is a cross-sectional view taken along line B—B indicated in FIG. *2a;*

Figure 3:
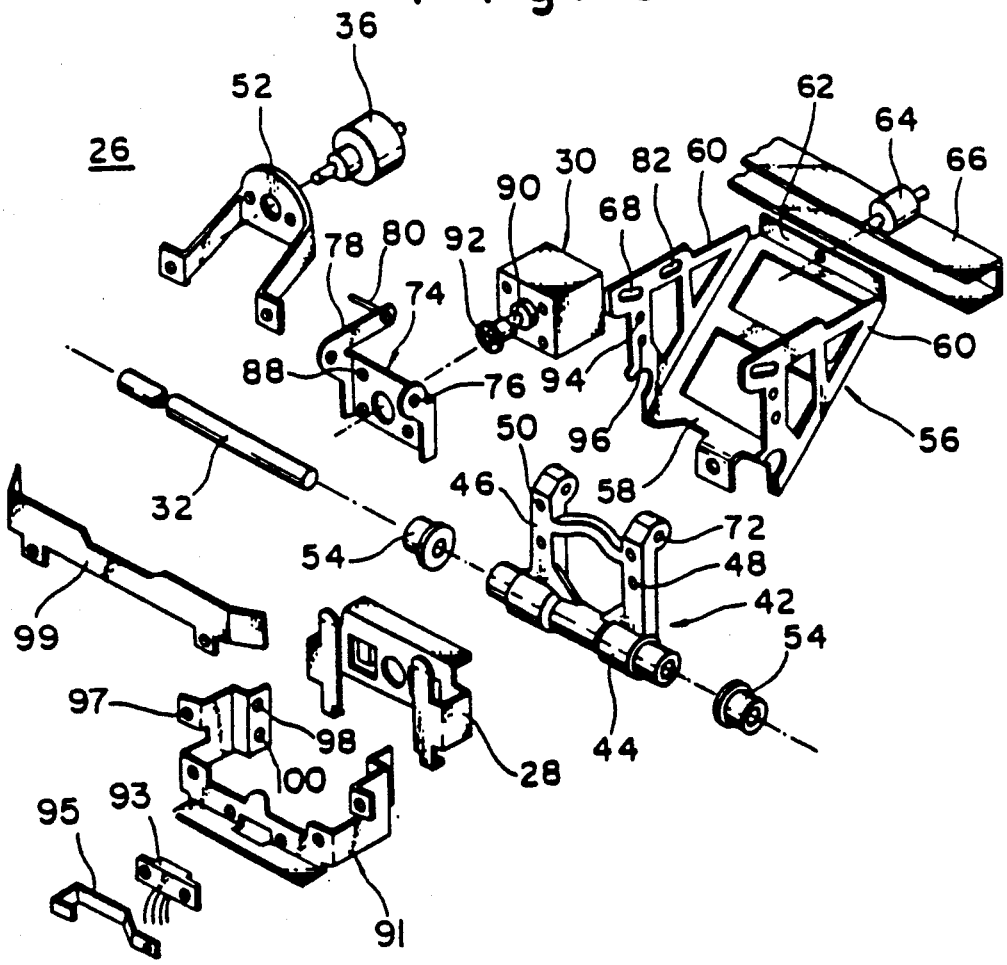
Figure 4:
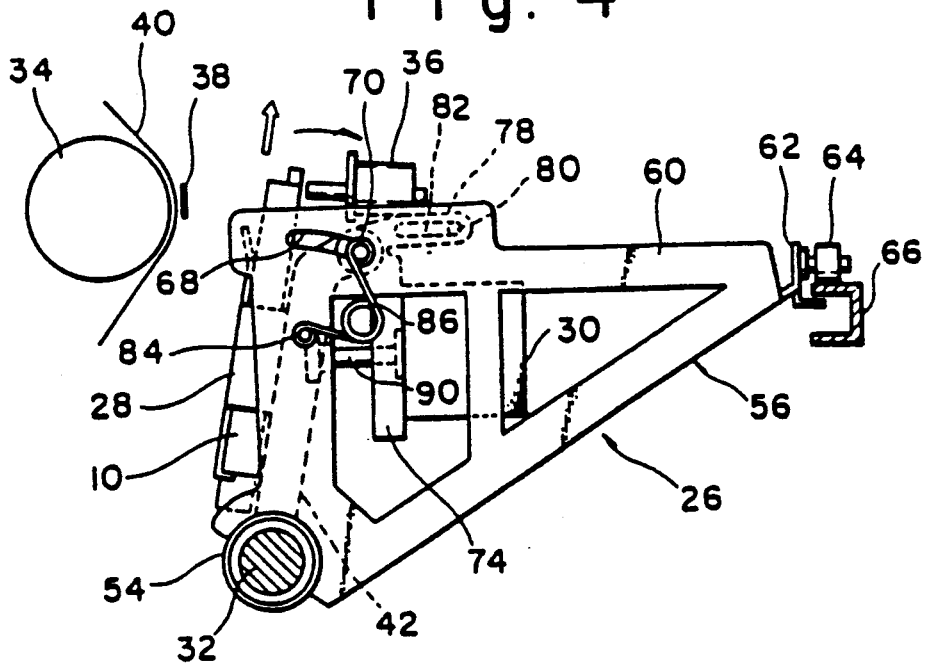
Figure 5:
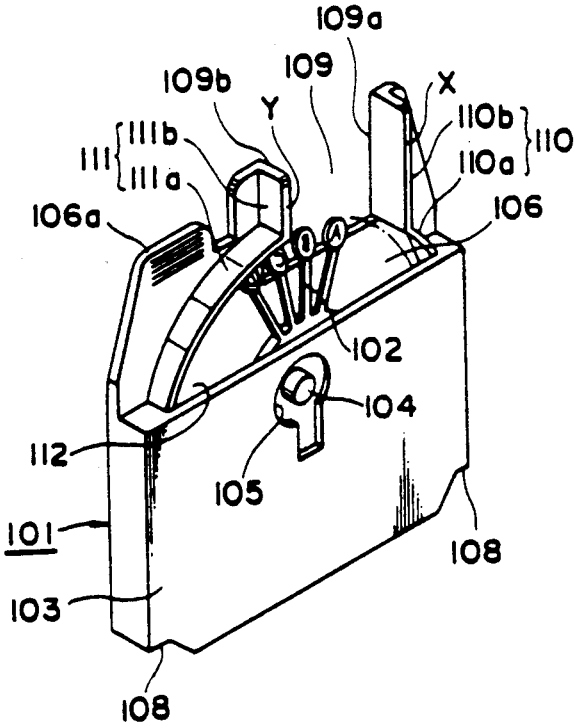
Figure 6:
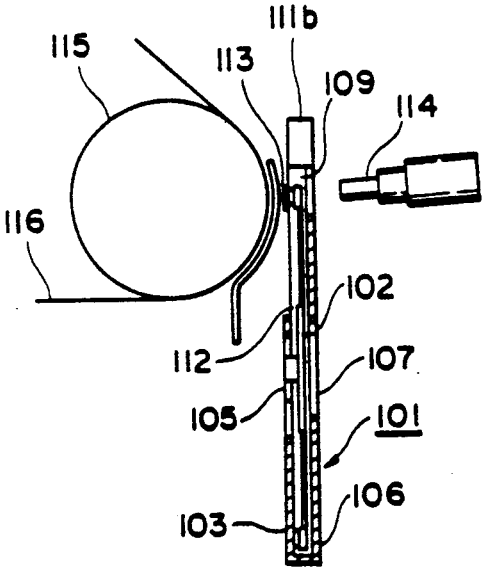
Figure 7:
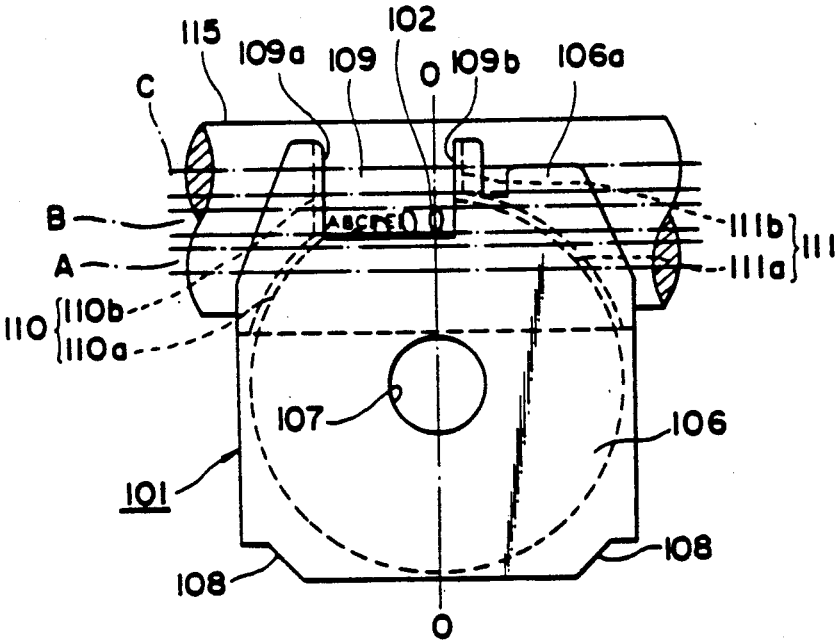

FIG. 3 is an exploded view of the structure shown in FIG. 1;

FIG. 4 is the same view as that of FIG. 1 but indicating the state in which the type wheel cassette mounted in the supporting structure may be removed when pulled in the direction indicated by the white arrow;

FIG. 5 is a perspective view showing the cassette-housed type wheel constructed in accordance with one embodiment of the present invention;

FIG. 6 is a schematic illustration showing how a printing operation is carried out with the type wheel of FIG. 5 set in position; and FIG. 7 is a schematic illustration of the structure shown in FIG. 6 when viewed from the right in FIG. 6.

DESCRIPTION OF THE PREFERRED EMBODIMENTS

Referring now to FIG. 1, there is shown the type wheel supporting structure embodied in the carriage of a printing machine in accordance with the present invention. As shown, a cassette 10 rotatably housing therein a type wheel, which is often called "daisy wheel" and whose structure will be described more in detail later, is detachably mounted on a carriage 26 which is supported to be movable in a reciprocating manner along a platen roller 34 as will be described more in detail later. As illustrated in FIGS. *2a* and *2b*, the type wheel 12 includes a hub 16, which is provided with crown teeth 14 at its rear surface, a plurality of spokes 18 radially extending from the hub 16 and a plurality of types 20 provided at the free ends of spokes 18. It is to be noted that, in the illustrated example, the types are provided one for each of the spokes 18; however, two or more types may be provided for each spoke as aligned in the lengthwise direction of the spoke as spaced apart one from another or no types may be provided in some of the spokes. At a predetermined position of the front surface of hub 16 is provided a home position mark 22 which may be viewed through a notch 24 provided in the cassette 10 when the type wheel 12 is housed in the cassette 10.

As shown in FIG. 1, the cassette 10 housing therein the type wheel 12 is detachably mounted in a holder 28 provided in the carriage 26. Under the condition of FIG. 1, the type wheel 12 is in operative connection with a selection motor 30 so that when the motor 30 is driven to rotate in accordance with a type selection signal, the type wheel 12 is driven to rotate within the cassette 10 to have a selected type located at a predetermined angular position which defines a printing position. As is well known in the art, the carriage 26 is slidably supported on a supporting shaft 32 which extends in parallel with the platen roller 34, and thus the carriage 26 moves along the platen roller 34 as driven by a space motor (not shown) intermittently or continuously depending upon a selected printing mode. While the carriage 26 moves along the platen roller 34 as guided by the supporting shaft 32 as described above, the selection motor 30 drives to rotate the type wheel to have selected types located at the printing position one after another and, each time when a selected type is located at the printing position, an impact hammer 36 is energized to impact the selected type located at the printing position against the platen roller with an ink ribbon 38 and a sheet of paper 40 sandwiched therebetween so that desired characters may be printed on the sheet of paper 40 along a printing line.

In the illustrated embodiment, the carriage 26 is provided with a holder supporting frame 42. As best illustrated in FIG. 3, the holder supporting frame 42 includes a sleeve 44, through which the supporting shaft 32 extends, and a generally H-shaped frame 46 which extends radially from the sleeve 44. The H-shaped frame 46 is provided with a pair of threaded holes 48 one on each of and at the center of its leg sections, so that the holder 28 for holding therein the cassette 10 is fixedly attached to the H-shaped frame by means of screws. The H-shaped frame 46 is also provided with another pair of threaded holes 50 each located as radially spaced away from the the above-described threaded holes 48. Thus, a hammer bracket 52 is fixedly attached to the H-shaped frame 48 by means of screws using these threaded holes 50. The impact hammer 36 is fixedly mounted on the hammer bracket 52 so that the hammer 36 may impact the rear surface of free end of spoke 18 thereby causing the type 20 provided at the front surface to be pressed against the platen roller 34.

On the other hand, the sleeve 44 of holder supporting frame 42 is provided with a pair of caps 54 of synthetic resin one on each end, and a carrier frame 56, whose structure will be described in detail later, is provided with its front bottom end resting on the caps 54. The carrier frame 56 is integrally formed and it includes an inclined bottom frame 58, a pair of generally rectangularly shaped side frames 60 one on each side of the inclined bottom frame 58 and a rear frame 62 which extends upward from the rear end of the bottom frame 58. A roller 64 is rotatably provided on the rear frame 62 and it is in rolling contact with a guide rail 66 which extends in parallel with the platen roller 34. Thus, the carriage 26 is supported between the supporting shaft 32 and the guide rail 66 to be reciprocatingly movable along the platen roller 34.

The side frames 60 of carrier frame 56 are each provided with an arc-shaped slot 68 with its center of arc located at the axis of supporting shaft 32, and a connection shaft 70 is provided as fitted in these arc-shaped slots 68. The connection shaft 70 extends through holes 72 provided in the H-shaped frame 46 of holder supporting frame 42 and it also extends through holes 76 provided in side projections of motor bracket 74. The motor bracket 74 also includes an arm 78 which extends rearwardly from the top of its side projection and which is fixedly provided with an engaging pin 80 at its free end. The engaging pin 80 becomes fitted in a straight slot 82 provided as extending horizontally in the left side frame 60 of carrier frame 56 as spaced apart from the arc-shaped slot 68 in the backward direction when assembled. Accordingly, when assembled, the motor bracket 74 becomes mounted on the carrier frame 56 as depending downward therefrom by means of connection shaft 70 and engaging pin 80 and thus it is movable closer to or separated away from the platen roller 34 as guided by the arc-shaped slots 68 and the straight slot 82. Also provided is a pair of toggle springs 86 each of which has its one end engaged with on end of connection shaft 70 and the other end engaged with a pin 84 which is fixedly planted in the corresponding side frame 60. With this structure, the motor bracket 74 may be urged to an operative position where the type wheel cassette 10 is located closer to the platen roller 34 so that printing operation may be carried out or to an inoperative position where the type wheel cassette 10 is located away from the platen roller 34 so that no printing operation takes place but the cassette 10 may be removed from the holder 28 for replacement selectively as guided by the arc-shaped slots 68 and the straight slot 82. In this respect, FIG. 1 indicates the condition in which the type wheel cassette 10 is at the operative position and FIG. 4 illustrates the condition in which the cassette 10 is at the inoperative position or the position for replacing cassettes 10.

The motor bracket 74 is also provided with a plurality of mounting holes 88 through which screws (not shown) are extended to have the selection motor 30 fixedly mounted on the motor bracket 74. The motor 30 has a motor shaft 90 which extends through a center hole formed in the motor bracket 74 and a crown gear 92 is fixedly mounted at the free end of motor shaft 90. Thus, when the motor bracket 74 is located at the operative position shown in FIG. 1 as urged by the toggle spring 86, the crown gear 92 comes into engagement with the crown teeth 14 of type wheel 12.

The side frames 60 of carrier frame 56 are each provided with a pair of mounting holes 94 and 96 in their forward portions. A front frame 91 has a pair of side sections each provided with a pair of mounting holes 98 and 100 aligned in position with the pair of mounting holes 94 and 96 when assembled, and, thus, the front frame 91 may be fixedly attached to the carrier frame 56 by inserting fixing members (not shown) through the corresponding ones of these mounting holes. A sensor 93 is mounted on the front end of front frame 91 and it detects the before-mentioned home position mark 22 on, the type wheel 12. At the front end of front frame 91 is also provided a leaf spring 95 which urges the type wheel 12 housed in the cassette 10 rearwardly thereby securely maintaining the engagement between the crown teeth 14 of type wheel 12 and the crown gear 92 of motor shaft 90. The front frame 91 is also provided with a pair of holes 97 through which a card holder 99 is fiexdly mounted.

With the above-described structure, under the condition of FIG. 1, the motor shaft 90 of selection motor 30 is operatively connected to the type wheel 12 so that the type wheel 12 is driven to rotate to have a selected type located at a predetermined printing position as described before and then the impact hammer 36 is energized to apply an impact to the selected type thus located at the printing position thereby forming a printed character on the sheet of paper 40. In this manner, printing operation may be carried out in the condition shown in FIG. 1. Then, if it is desired to have the cassette-housed type wheel 12 replaced by another cassette-housed type wheel, the holder supporting frame 42 is moved clockwise in FIG. 1 around the supporting shaft 32 against the force of toggle springs 86 manually or by means of an appropriate means thereby moving the motor bracket 74 rotatably supported by and depending from the connection shaft 70 fitted into the holes 72 of holder supporting frame 42 in the backward direction so that the crown gear 92 becomes disengaged from the crown teeth 14 and the connection shaft 70 and the engaging pin 80 are brought into abutment against the backward ends of arc-shaped and straight slots 68 and 82 by means of toggle springs 86. As a result, the holder supporting frame 42 pivots clockwise around the supporting shaft 32 to be located at its retracted position separated away from the platen roller 34 thereby establishing the condition shown in FIG. 4 wherein the top of the cassette holder 28 is made wide open so that the cassette-housed type wheel 12 may be replaced with another.

In the above-described embodiment, the cassette holder 28 is so structured to pivot around the supporting shaft 32; alternatively, a horizontal shaft may be provided in the carrier frame 56 and the cassette holder 28 may be so provided to pivot around such a horizontal shaft. Thus, it is only necessary to provide the cassette holder 28 pivotally or rockably. Further, in the above-described embodiment, it is so structured that the motor bracket 74 which supports the motor 30 in position moves as guided by the arc-shaped and straight slots 68 and 82 defined appropriately in the carrier frame 56. Alternatively, the motor bracket 74 may also be so provided to be movable as guided by guide rails instead of profiled slots. For example, instead of an engagement between the straight slot 82 and the engaging pin 80, it may be so structured that the carrier frame 56 is provided with a projection and the motor bracket 74 is provided with a hole engageable with the projection In addition, in the above-described embodiment, the engagement between the type wheel 12 and the motor shaft 90 is established by the crown teeth 14 and the crown gear 92. However, the present invention should not be limited only to this and any other engaging mechanism may be used. For example, a profiled hole may be provided in the hub of type wheel 12 and the tip end of motor shaft 90 may be correspondingly configured, in which insertion of the tip end of motor shaft 90 into the profiled hole will allow transmission of rotating force from the motor shaft 90 to the type wheel 12. Besides, instead of the toggle springs 86, any other toggle means may also be used to urge the cassette 10 counterclockwise or clockwise selectively.

FIG. 5 shows in perspective a type wheel cassette 101 constructed in accordance with one embodiment of the present invention which may be advantageously used as detachably installed in the printing machine as described above with reference to FIGS. 1 through 4. As shown, the cassette 101 is generally in the form of a box and houses therein a type wheel 102 somewhat loosely. The cassette 101 includes a front wall 103 which is formed with an opening 105 through which an appropriate pusher member (not shown) may extend to press a hub 104 of type wheel 102. As shown, the front wall does not extend all the way to the top but it terminates short at the horizontal line which is located somewhere between the center of type wheel 102 and the top thereof, so that the substantial top portion of type wheel 102 is exposed. The cassette 101 also includes a rear wall 106 which extends generally to the top of cassette 101 and which is provided with another opening 107 through which the motor shaft 90 may extend to establish an engagement between the motor shaft 90 and the type wheel 102.

The cassette 101 is provided with right and left recessed portions 108, 108 at the right and left bottom corners which may be advantageously used for positioning the cassette 101 in position when mounted in the cassette holder 28. As best shown in FIG. 7, the cassette 101 is also provided with a printing window 109 which is generally rectangular in shape, particularly elongated sideways substantially, and located at its top as shifted to the left from its longitudinal center line O—O. Such arrangement of printing window 109 as shifted to the left with respect to the longitudinal center line O—O constitutes one feature of the present cassette-housed type wheel. Here, it is assumed that the cassette 101 housing therein the type wheel 102 moves to the right in FIG. 7 along a platen roller 115 as a printing operation proceeds. In terms of size, the printing window is preferably so structured that it allows an impact hammer 114 to extend therethrough to impact on a selected type located at a printing position without interference and its horizontal length from center line O—O to its left side edge 109*a* is twice or more of the horizontal length from center line O—O to its right side edge 109*b*.

Of importance, a pair of profiled ribs 110 and 111 are provided on that portion of the front surface of rear wall 106 where the front wall 103 is absent. These ribs 110 and 111 each include arc-shaped rib sections 110*a* and 111*a*, which are generally concentric with the type wheel 102 housed in the cassette 101 and thus partly enclose the type wheel 102, and straight, vertical rib sections 110*b* and 111*b*, respectively. The ribs 110 and 111 project upright from the front surface of rear wall 106 and it is preferably at least as high as the front surface of type wheel 102. As a result, when the present cassette 101 is mounted in position as schematically shown in FIG. 6, an ink ribbon 113 may be fed in contact with and thus guided by end surfaces X and Y of these ribs 110 and 111, so that the ink ribbon 113 is prevented from being tangled with the type wheel 102. Thus, it is preferable that the ribs 110 and 111 have such a height that will keep the ink ribbon 113 spaced apart from the type wheel 102 with a predetermined gap therebetween.

It is to be noted that the ribs 110 and 111 in the illustrated embodiment extend from a mouth 112 between the front and rear walls 103 and 106 to the top end of printing window 109. Accordingly the ribs 110 and 111 serve as guides for feeding of ink ribbon 113 even if the ink ribbon 113 is located at position A for inspecting typed characters, at position B for normal printing operation or at position C for correcting mistypes. Since the ink ribbon 113 is only in sliding contact with the end surfaces X and Y of these ribs 110 and 111, if the cassette 101 is pulled upward by grabbing its holding section 106*a* formed by an extension of the rear wall 106 under the condition of FIG. 4, then the cassette 101 may be easily removed from the holder 28 without removal of a ribbon cassette (not shown) from which the ink ribbon 113 is fed.

As best shown in FIG. 7, the printing window 109 is so formed as shifted to the left with respect to its longitudinal center line O—O, so that the vertical and straight rib portion 111*b* may be located as close as possible to a passage of impact hammer 114 thereby allowing to prevent the ink ribbon 113 from being detained by the type wheel 102, particularly its types, more effectively during printing operation. Moreover, since the printing window 109 is located as shifted to the left with respect to the center line O—O of cassette 101, an increased number of typed characters on the sheet of paper 116 placed around the platen roller 115 may be inspected at a time.

In the above-described embodiment, the straight rib portions 110*b* and 111*b* are formed continuously with the corresponding arc-shaped rib portions 110*a* and 111*a*. However, as an alternative structure, these straight rib portions 110*b* and 111*b* may be formed separately from the arc-shaped rib portions 110*a* and 111*a*. Furthermore, the printing window 109 in the above-described embodiment is open at its top; however, any connection member may be provided as bridging between the straight rib portions 110*b* and 111*b*, in which case the printing window 109 is not open at its top but defined as a closed loop.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A printing machine comprising:

a biasing means;

a type wheel driving motor means having a shaped drive shaft;

a unit which is formed of a cassette and a type wheel and comprises:

a rotary type wheel which has a central hub and type spokes extending radially herefrom, wherein the hub has a central front projection means extending axially therefrom in a forward direction and central rear projection means extending axially therefrom in a rearward direction;

a cassette which has a front wall and a rear wall and a side wall which joins peripheral portions of the front and rear walls, wherein the front and rear walls are substantially parallel to each other and are spaced from each other to define an interior space in which the type wheel fits loosely and said cassette is free of cassette-mounted spring means acting on the type wheel;

wherein:

the front wall of the cassette has an opening which loosely receives the front projection means of the hub to allow free rotation of said front projection means within said opening in the front wall of the cassette, and wherein said front projection means of the hub includes means for engaging said opening in the front wall of said cassette to limit radial movement of the type wheel relative to the cassette;

the rear wall of the cassette has an opening which loosely receives the rear projection means of the hub to allow free rotation of said rear projection means within said opening in the rear wall of the cassette, and wherein said rear projection means of said hub includes means for engaging said opening in the rear wall of said cassette to limit radial movement of said type wheel relative to said cassette;

the axial distance between the front and rear walls relative to the axial distance between said means for engaging included in said front and rear projection means of said hub is selected to allow limited axial movement of the type wheel within the cassette, and to limit radial movement of said type wheel relative to said cassette by causing at least one of said means for engaging to engage the respective wall of said cassette at any one time; and wherein the unit can be set in a printing position in the printing machine in which said biasing means engages and urges rearwardly the front projection means of the hub to thereby urge the hub into self-centering engagement with said shaped drive shaft of said type wheel driving motor means;

said rear wall of the cassette further having a top opening which exposes the ends of at least some of said spokes.

2. A printing machine in combination with a cassette housing a type wheel having a central hub which is provided with (i) drive engaging means, (ii) a front projection means, and (iii) a rear projection means, said cassette being detachably mountable at a printing position in said printing machine, said printing machine having means engaging the front projection means of the type wheel when the cassette is in said printing position to urge the type wheel rearwardly and having a selection motor means and said type wheel further having a plurality of spokes extending radially from the central hub thereof and types provided at the free ends of at least some of the spokes, said cassette comprising:

a rear wall having a hub opening shaped and dimensioned to (i) allow the drive engaging means of the central hub of the type wheel to be drivingly engaged by a selection motor means and (ii) loosely receive said rear projection means of the central hub of the type wheel;

a front wall connected to the rear wall at least partly to form an integral structure therewith within which the print wheel can rotate, wherein said front wall is spaced forwardly from the rear wall to allow space for positioning the type wheel between said front and rear walls of the cassette, wherein said front wall has a hub opening which is opposite the hub opening in the rear wall and loosely receives said front projection means of the central hub of the type wheel, wherein said cassette is ree of cassette-mounted spring means acting on the type wheel and wherein the spacing between the front and rear walls of the cassette relative to the axial distance between the hub's front and rear projection means is such that at any time at least one of the front and rear projection means is received in the respective hub opening of the respective wall to limit radial movement of the type wheel relative to the cassette.

3. A printing machine in combination with a cassette as in claim 2, wherein said printing machine includes a photosensor and said type wheel has a marker and said front wall of said cassette has a cut-away portion which is continuous with said central opening in the front wall and is aligned with the photosensor when the cassette is mounted in the printing position to thereby allow detection of said marker with said photosensor.

4. A printing machine in combination with a cassette as in claim 2 wherein said front wall of said cassette is shorter vertically than said rear wall, to thereby expose a portion of said rear wall, and said cassette further comprises guiding means which are fixedly provided at said exposed top portion of the rear wall to engage an ink ribbon when said cassette is in said printing position and to thereby keep the ink ribbon from being detained by said type wheel.

5. A printing machine in combination with a cassette as in claim 2 wherein said rear wall of said cassette has at its upper part a printing window which is asymmetrical with respect to a vertical diameter of the print wheel.

6. A printing machine comprising:

a biasing means acting in an axial direction;

a cassette housing a rotary type wheel which has a central hub, a plurality of spokes extending radially from said hub, types provided at least at some of said plurality of spokes, first axial projection means at a first surface of said hub and second axial projection means at a second surface of said hub opposite said first surface, a first wall which has a first opening for loosely receiving therein said first projection means of said central hub of said type wheel, a second wall which is integral with but is spaced by a predetermined distance from said first wall, wherein said second wall has a second opening for loosely receiving therein said second projection means of said central hub of said type wheel; and wherein said type wheel is housed in said cassette for rotary movement with respect thereto and said predetermined distance is such that at least one of said first projection means and first opening and said second projection means and second opening engage each other to limit radial movement of the type wheel with respect to the cassette, and wherein said cassette is free of spring means acting on the type wheel; and said biasing means of the printing machine urges one of said projection means of the type wheel in said axial direction when said cassette is in a printing position.

7. A printing machine as in claim 6 wherein each of said first and second projection means conforms to a generally circular locus and each of said first and second openings has a generally circular shape.

8. A printing machine as in claim 7 wherein said first and second circular openings in said first and second walls of the cassette, respectively, are axially aligned.

9. A printing machine as in claim 8 wherein said type wheel is freely rotatable within said cassette, about an axis which is coaxial with said openings.

10. A printing machine as in claim 6 wherein said second wall of said cassette has a shape which generally covers a rear side of said type wheel and said first wall of said cassette generally corresponds in shape to said second wall except that its top portion is partly removed to partly expose a front side of said type wheel.

11. A printing machine as in claim 10 further comprising a third wall extending between said first and second walls of said cassette along their peripheries.

12. A printing machine comprising:

a cassette-type wheel unit comprising:

a cassette having a front wall provided with an opening, a rear wall, and a side wall connecting peripheral portions of the front and rear walls and spacing the front and rear walls from each other to leave interior space therebetween; and a type wheel rotatably housed in said interior space of the cassette and having a central hub provided with a front projection means which loosely fits in said opening in the front wall of the cassette to thereby allow free rotation of the type wheel in the cassette but to allow only limited radial motion of the type wheel relative to the cassette and thereby to resist removal of the type wheel from the cassette;

wherein the rear wall includes an opening aligned with that in the front wall and the type wheel hub has a rear projection means which loosely fits in said opening in the rear wall; and wherein said cassette is free of spring means and the axial distance between the axial extremes of said front and rear projection means is at least as great as the axial dimension of said interior space at said openings; and a biasing means mounted in the printing machine and urging the front projection means of the type wheel rearwardly.

13. A printing machine as in claim 12 in which the front wall of said cassette terminates at a level generally conforming to a chord of the type wheel which in a printing position of the unit is generally horizontal and is between the opening in the front wall and the top extent of the type wheel.

14. A printing machine as in claim 13 in which the rear wall of said cassette has an upwardly extending portion which reaches above the type wheel when the unit is in a printing position and has ribs which extend forwardly from said upwardly extending portion to form ribbon guides.

15. A printing machine as in claim 14 in which said side wall of said cassette includes a portion which extends forwardly from a portion of the rear wall which when the cassette is in a printing position extends above the chord at which the front wall terminates.

16. A printing machine as in claim 15 in which said upwardly extending portion of the rear wall of said cassette comprises a pair of columns which are horizontally spaced from each other when the unit is in a printing position.

17. A printing machine as in claim 16 in which the biasing means comprises a spring acting on said front projection means of the type wheel hub.

18. A printing machine as in claim 16 in which the rear side of the type wheel has a portion comprising drive shaft engaging means.

19. A printing machine as in claim 18 in which said portion of the hub wheel which comprises said drive shaft engaging means surrounds the outline of the front projection means of the hub and is accessible through said opening of the rear wall of the cassette.

20. A printing machine as in claim 19 in which said side wall of said cassette has a generally polygonal outline which includes, when the unit is at a printing position, a horizontal centrally located straight portion flanked by two inclined portions and two vertical portions which are above the inclined portions.

21. A printing machine as in claim 20 in which said columns are spaced inwardly of said vertical portions of the side wall of said cassette.

22. A printing machine as in claim 21 in which the rear wall of said cassette has a top opening which is asymmetrical with respect to a vertical diameter of the type wheel.

23. A printing machine comprising:

a platen roller;

a cassette for housing therein a type wheel having a central hub with a front projection means;

means for detachably mounting the cassette in said printing machine and for permitting movement of the cassette between a printing position and a retracted position;

biasing means engaging and urging rearwardly said front projection means of the type wheel hub when the cassette is in said printing position;

said cassette comprising a rear wall having a first defined shape and provided with a printing window at its top portion and with a hub engaging opening, a front wall connected to said rear wall at least partly at its side to thereby form an integrated structure together with said rear wall and an internal space for housing therein said type wheel such that said type wheel is free to rotate within said cassette when the cassette is not mounted in said printing machine, said front wall having a second defined shape such that it is shorter in vertical height than said rear wall, to thereby expose a top portion of said rear wall;

wherein said front wall also has a hub engaging opening loosely receiving said front projection means of the hub of the type wheel for rotation and for axial movement therein, said hub further having a rear projection means which is loosely receivable within said hub engaging opening of said rear wall for rotation and for axial movement therein, and wherein the axial distance between said front and rear walls relative to the axial distance between said front and rear projection means at said hub engaging openings is such that at any one time an engagement between at least one of said projection means and at least one of said hub engaging openings limits radial movement of the type wheel relative the cassette; and guiding means fixedly provided on said exposed top portion of said rear wall, said guiding means being engageable with an ink ribbon when said cassette is set in position for printing operation to help prevent said ink ribbon from being detained by said type wheel.

24. A printing machine as in claim 23 wherein said printing window in said rear wall of said cassette is generally rectangular in shape and said guiding means includes a pair of straight ribs each provided along the vertical sides of said generally rectangular printing window.

25. A printing machine as in claim 24 wherein said guiding means further includes a pair of arc-shaped ribs, said arc-shaped ribs being provided along an outer radial periphery of said type wheel.

26. A printing machine as in claim 25 wherein said straight ribs have bottom ends and said arc-shaped ribs extend from both sides of a mouth defined between said rear and front walls of said cassette to the bottom ends of the straight ribs, respectively.

27. A printing machine comprising:

a biasing means;

a cassette housing therein a rotary type wheel having a hub with front and rear axial projection means;

means for detachably mounting said cassette for movement relative to said biasing means between a printing position and a retracted position;

said biasing means engaging and urging rearwardly said front projection means when the cassette is in said printing position;

wherein said cassette comprises:

a rear wall having a first defined shape and provided with a printing window at its top portion and with a hub receiving opening shaped to receive loosely said rear axial projection means of said hub; and a front wall connected to said rear wall at least partly at its side to thereby form an integrated structure together with said rear wall and an internal space for housing therein said type wheel, said front wall having a second defined shape and being provided with a hub receiving opening shaped to receive loosely said front projection means of said hub; and wherein said type wheel loosely fits in said cassette and is free to rotate therein when said cassette is not mounted in a printer, and the axial distance between said front and rear walls at said hub receiving openings relative to the axial distance between said front and rear projection means is such that the radial movement of said type wheel relative to said cassette is limited at all times by the engagement of at least one of said front and rear projection means with a respective hub engaging opening.

28. A printing machine as in claim 27 wherein said printing window in said rear wall of said cassette has vertical sides and the distance between said center line and one of said vertical sides is twice or more the distance between said center line and the other of said vertical sides.

29. A printing machine as in claim 28 wherein said printing window in said rear wall of said cassette is generally rectangular in overall shape.

30. A printing machine comprising:

a platen roller having a rotational axis;

biasing means mounted at a fixed position relative to the rotational axis of the platen roller;

a holder mounted in the printing machine to move between a forward, printing position and a rearward, retracted position such that in the printing position at least a portion of said holder is closer to the platen roller than in the retracted position;

a cassette detachably mountable in said holder to move therewith between said printing and retracted positions, said cassette housing a type wheel which has a central hub having a front projection means and a rear projection means and said cassette having openings for loosely receiving said projection means;

wherein said biasing means engages and urges rearwardly said front projection means of the type wheel hub when said holder and cassette are in said printing position.

31. A printing machine as in claim 30 in which said biasing means comprises a spring.

32. A printing machine as in claim 31 in which said spring is a leaf spring.

* * * * *